US011620969B1

(12) United States Patent
Hernandez

(10) Patent No.: US 11,620,969 B1
(45) Date of Patent: Apr. 4, 2023

(54) SPRING BRACING SYSTEM FOR STRINGED MUSICAL INSTRUMENTS

(71) Applicant: Albert Hernandez, Cranford, NJ (US)

(72) Inventor: Albert Hernandez, Cranford, NJ (US)

( * ) Notice: Subject to any disclaimer, the term of this patent is extended or adjusted under 35 U.S.C. 154(b) by 0 days.

(21) Appl. No.: 17/822,087

(22) Filed: Aug. 24, 2022

(51) Int. Cl.
*G10D 3/00* (2020.01)
*G10D 3/04* (2020.01)
*G10D 3/02* (2006.01)

(52) U.S. Cl.
CPC ..... *G10D 3/02* (2013.01); *G10D 3/04* (2013.01)

(58) Field of Classification Search
CPC ..... G10D 3/02; G10D 3/00; G10D 3/12–153
See application file for complete search history.

(56) References Cited

U.S. PATENT DOCUMENTS 476,907 A 6/1892 Tibbits
685,920 A 5/1901 Heck
688,893 A 12/1901 Springer
3,974,730 A * 8/1976 Adams, Jr. ..... G10D 1/08 84/291
1,253,371 A 3/1981 Guice
5,260,505 A 9/1993 Kendall
5,325,756 A 5/1994 Sugden
5,689,074 A * 11/1997 Penridge ..... G10D 3/02 84/267
7,446,247 B2 4/2008 Shellhamer
7,462,767 B1 9/2008 Swift
7,838,751 B2 * 11/2010 Hendricks ..... G10D 3/153 84/313
8,138,403 B1 * 3/2012 Kemp ..... G10D 3/02 84/267
8,203,059 B2 6/2012 Miloslavsky
8,969,692 B2 3/2015 Sanns, Jr.
8,975,497 B2 10/2015 Aspri
9,196,230 B1 11/2015 Elliot
10,013,957 B2 3/2018 Falbo
10,366,677 B2 7/2019 Tagliapini et al.
11,217,215 B2 4/2022 Coyle
2008/0190263 A1 * 8/2008 Drew ..... G10D 3/02 84/291

* cited by examiner

*Primary Examiner* — Christopher Uhlir

(57) ABSTRACT

The Spring Bracing System invention is disclosed for optimizing the musical voice of a stringed musical instrument by improving the transfer of musical string vibration energy and adding structural support and spring quality to targeted locations on the instrument's sound board. The Spring Bracing System, comprising a spring brace frame, a tensioning system, a fulcrum lever system, sound posts and sound braces, operates as a simple machine in transferring vibration energy generated when the instrument's strings are in motion. The adjustability of the system allows the musician to customize, optimize, and improve the musical voice of the instrument to his preference. On most steel string guitars, the Spring Bracing System can be installed without modification to the instrument. It can be installed in other types of stringed musical instruments, such as classical guitars, cellos and double basses, with minor modifications.

14 Claims, 10 Drawing Sheets

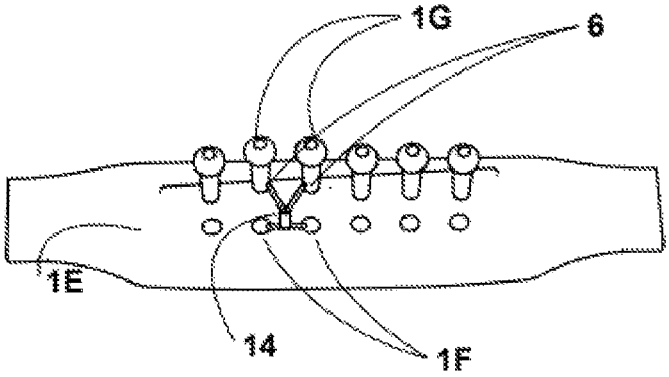
FIG. 1A
FIG. 1B
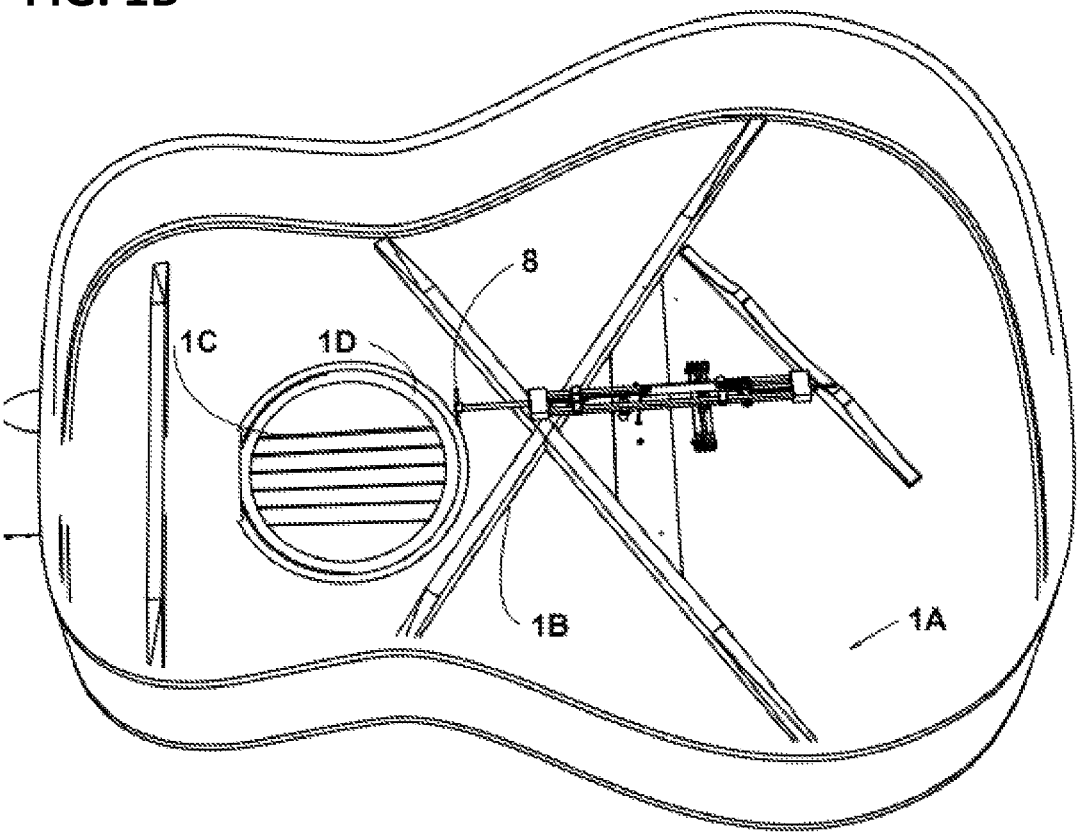

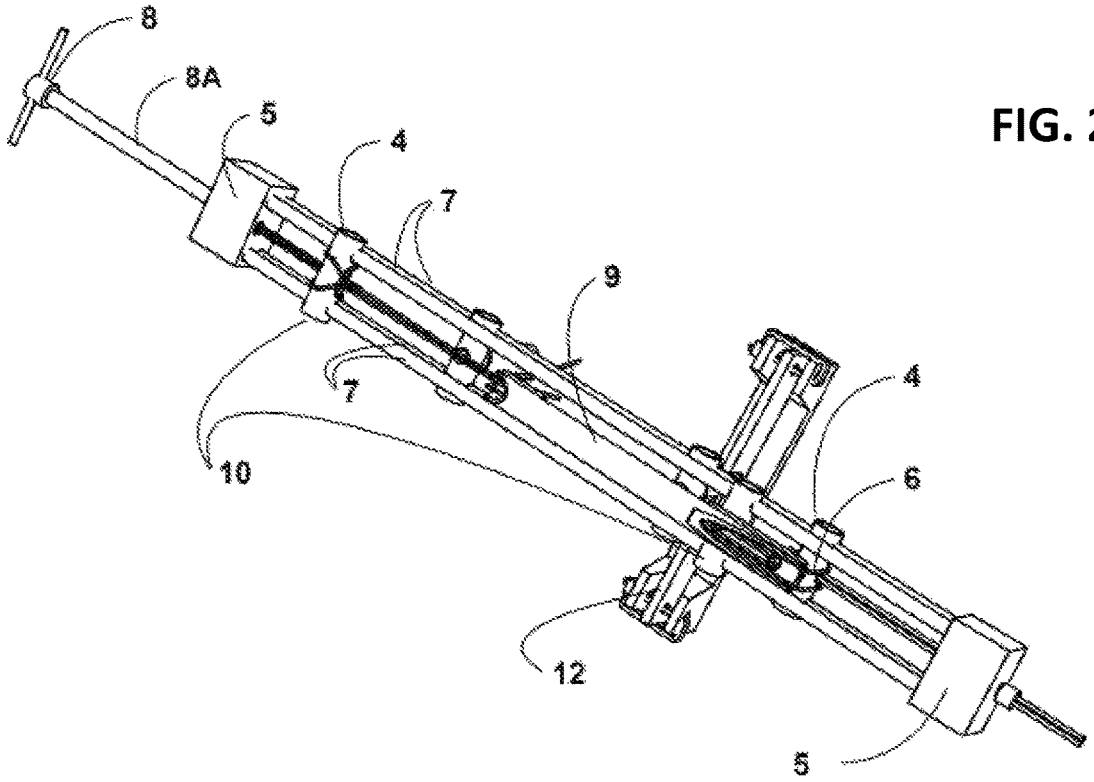
FIG. 2A
FIG. 2B
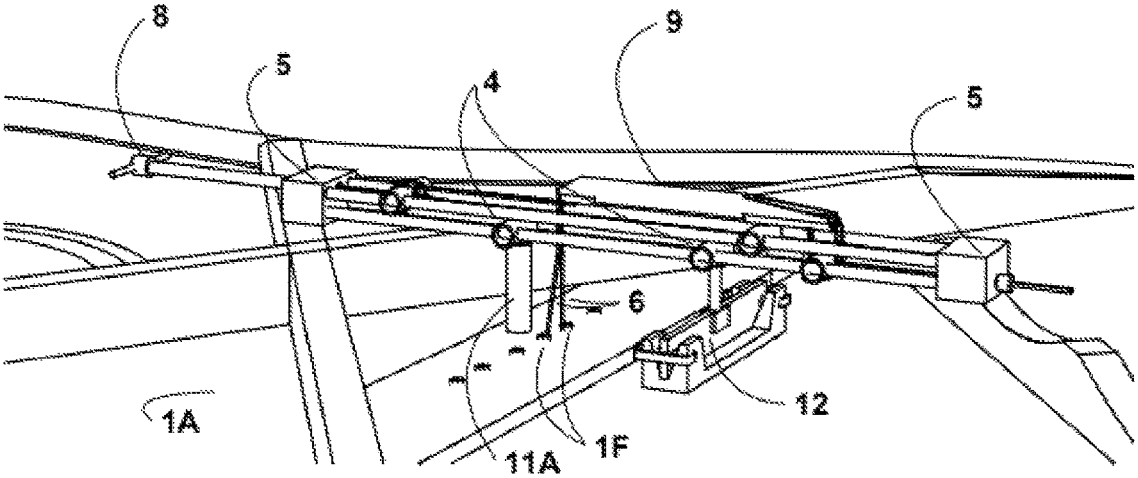

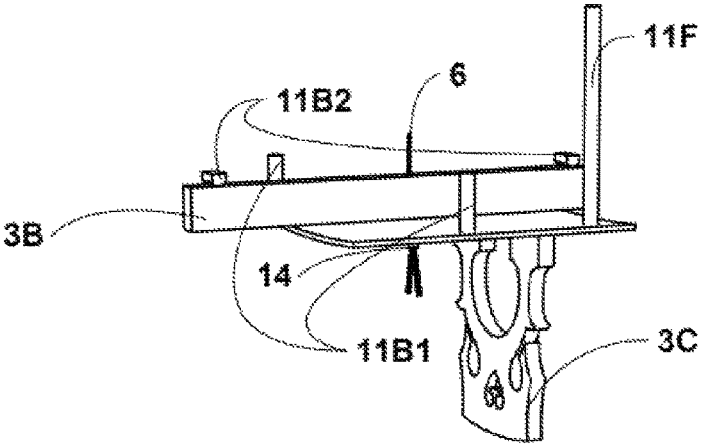
FIG. 5A
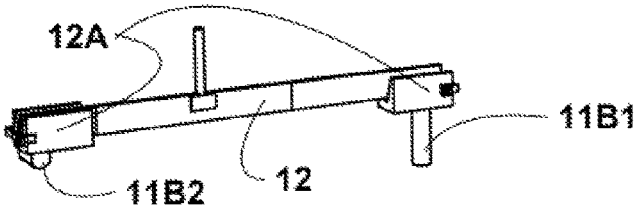
FIG. 5B
FIG. 5C
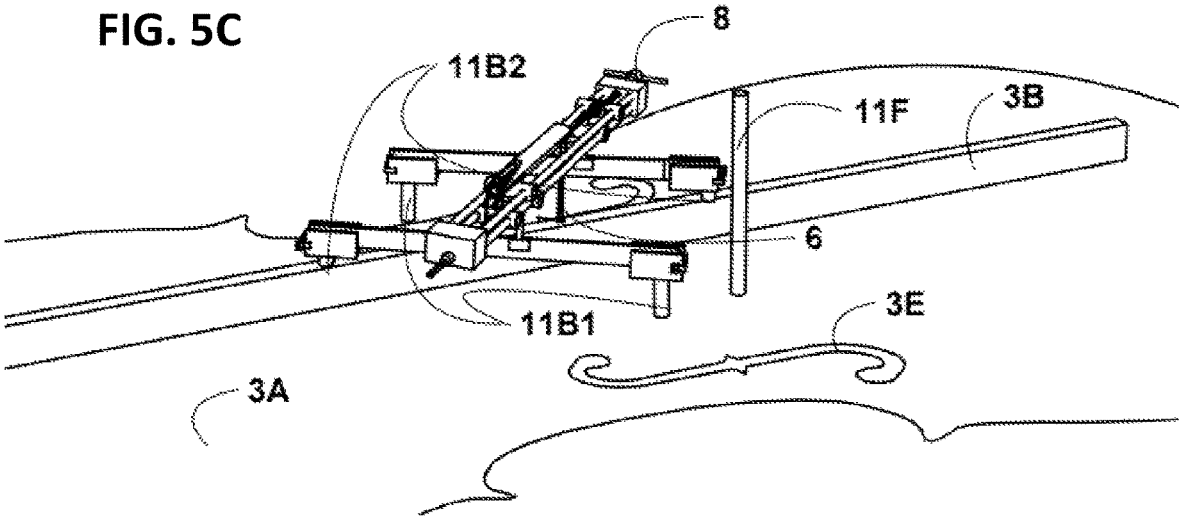

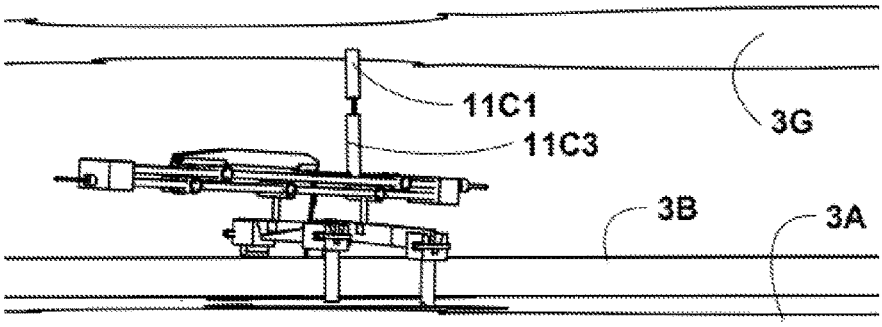
FIG. 6A
FIG. 6B
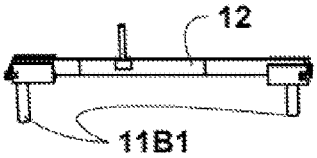
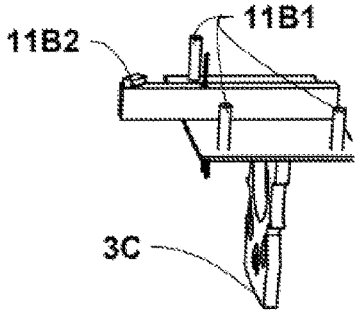
FIG. 6C
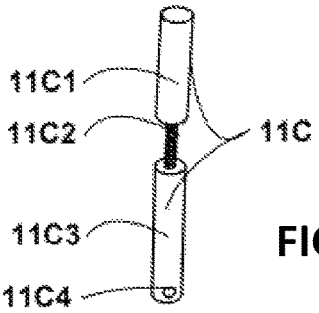
FIG. 6D
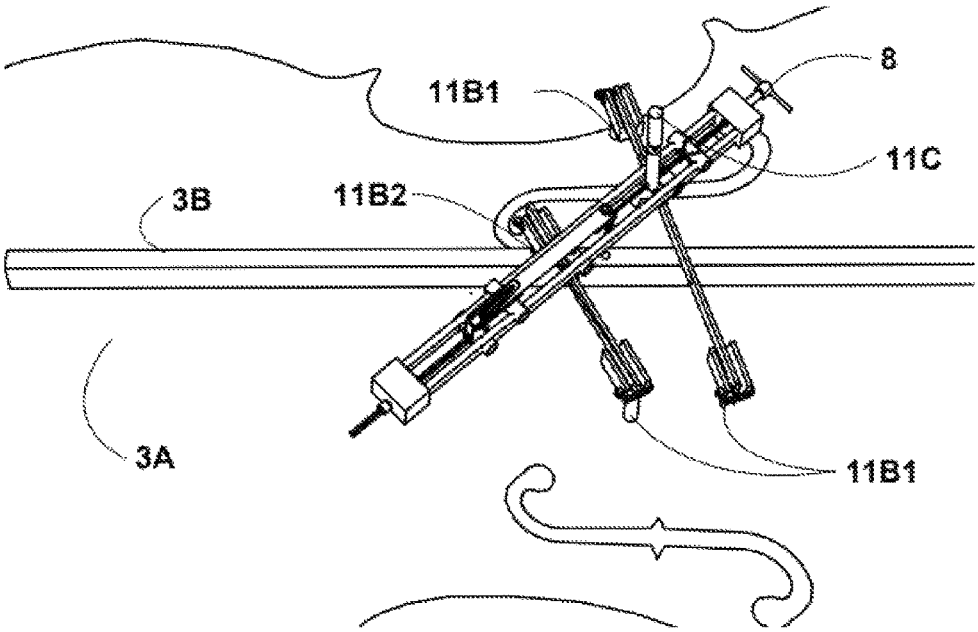
FIG. 6E

SPRING BRACING SYSTEM FOR STRINGED MUSICAL INSTRUMENTS

CROSS-REFERENCES

This application claims the benefit of provisional patent application Ser. No. 63/365,777, filed 2022 Jun. 2 by Albert Hernandez, the present inventor.

FIELD OF THE INVENTION

The present invention relates to a system comprised of a device and method to optimize and customize the musical sound of a stringed musical instrument by improving the transfer of string vibration energy and adding targeted structural support along with spring quality to varied parts of the instrument's sound board and bracing.

PRIOR ART

There have been many inventions claiming improved musical sound when utilized on a stringed acoustic musical instrument. Related to the present invention, the prior art shows several inventions that incorporate a tensioned cord, a key component of the String Brace System, within their inventions. J. H. Tibbits 1892 U.S. Pat. No. 476,907 utilizes a tension cord to replace the sound board bass bar brace on an arch top instrument. Tensioned cords are also utilized in Falbo's 2018 U.S. Pat. No. 10,013,957 B2 "Tension redistributing and balancing, for stringed instruments", Sann's 2015 U.S. Pat. No. 8,969,692 B2 "Acoustic String Tension compensating method and apparatus", and Swift's 2008 U.S. Pat. No. 7,462,767 B1 "Stringed Musical Instrument Tension Balancer". The prior art also shows inventions that incorporate suspended bracing, also an attribute of the present invention. Suspended bracing is incorporated in Kemp's 2012 U.S. Pat. No. 8,138,403 B1 "Brace for Stringed Instrument.", Shellhammer's 2008 U.S. Pat. No. 7,446,247 B2 "Suspended Bracing System for Acoustic Musical Instruments" inventions.

Review of the related prior art going as far back as 1892 found their functionality can generally be grouped into two categories. Specifically, those that provide additional structural support to the sound board, allowing the sound board to vibrate more freely, and those that function by improving the transfer of string vibration energy from the bridge to the sound board.

BACKGROUND OF THE INVENTION

Contrary to many claims made in the prior art, improving the musical sound of a stringed musical instrument is more complex than simply having the sound board vibrate more. Although acoustic stringed musical instruments all use string vibration in the same way to make sound, those familiar with the art would agree it's the way the vibration energy from the strings are focused at different parts of the sound board, making the sound board move as a whole, that makes a superior sounding instrument.

Handmade stringed instruments generally sound better than factory made instruments because during their construction, luthiers, those skilled in the art of making stringed musical instruments, utilize time tested techniques and their own experience to customize and optimize the voice of the instrument by changing the way parts on the sound board vibrate. For example, they carefully select sound board top materials that have spring quality and often carve the sound board braces and sand the sound board tops at specific locations while tapping on the sound board to hear the impact of those modifications. This produces an instrument that meets their expectations and the demands of the musician. It is well recognized that a master luthier can make an instrument of superior quality with the most inferior materials.

Review of the prior art shows these inventions have major shortcomings. Many are difficult and costly to produce and do not easily adapt to ready-made off the shelf factory or handmade instruments. Some are dedicated to flat top guitar instruments while others to arch top instruments, which include violins, cellos, and violas. Understanding how superior handmade instruments are constructed, it is evident these inventions are limited with regard to their adjustability and flexibility in targeting and affecting varied parts of the sound board and bracing to alter and optimize the voice of the instrument to the musician's preference. Accordingly, there is a need for a sound board improvement system that does not exhibit one or all of the shortcomings.

SUMMARY OF THE INVENTION

In light of the above stated background, the present invention is a new system for stringed musical instruments which addresses the shortcomings noted in the prior art. The Spring Bracing System improves the transfer of string vibration energy to the sound board and can be used to counter the rotational torque forces and downward forces caused by the instrument's tensioned strings onto the sound board.

An embodiment of this invention is disclosed where the Spring Brace System is used to replace a conventional sound post, commonly used on the arch top sound boards of cellos and violins for upward structural support. Rotational torque forces, created by flat top instruments, which include guitars that have string bridges permanently attached to their sound boards, are countered by the upward vertical force and opposing structural support provided by the Spring Bracing System.

Most unique than the prior art, the Spring Bracing System is designed to be highly adjustable. The system allows targeting structural supporting counterforces and the transfer of enhanced string vibration energy in varied ways on the instrument's sound board, allowing the musician to customize how the sound board vibrates and optimize the voice of the instrument to his preference.

The Spring Bracing System, can be installed on most steel string guitars that utilize bridge pins to fasten their strings to the bridge without any modification to the instrument. Installation only requires changing two of the instrument's bridge pins for ones that allow space to fit the two ends of the spring brace cord to fasten the system to the sound board. Other embodiments are also disclosed showing the invention installed in other types of stringed musical instruments with minor modifications. This adaptability with regard to different types of stringed musical instruments is not readily seen in the prior art.

Commercially, the Spring Bracing System is fairly inexpensive to manufacture and will allow factory constructed stringed musical instruments, often made by less experienced craftsman utilizing inferior materials, to sound much better. Also, it will provide a new option when designing superior sounding instruments or when opting to use higher tension strings on existing instruments.

BRIEF DESCRIPTION OF DRAWINGS

FIG. 1A is an external perspective view of a steel string guitar string bridge according to at least one embodiment discussed herein.

FIG. 1B is a perspective internal view of a steel string guitar with a Spring Bracing System therein according to at least one embodiment discussed herein.

FIG. 2A is a rear perspective close-up view of the Spring Bracing System according to at least one embodiment discussed herein.

FIG. 2B is a side perspective internal close-up view of a steel string guitar sound board with a Spring Bracing System therein according to at least one embodiment discussed herein.

FIG. 5A is a sectional view of an arch top stringed musical instrument sound board, showing the Spring Bracing System components that are in contact with the sound board in relation to the string bridge of the instrument according to at least one other embodiment discussed herein.

FIG. 5B is side view of the Spring Bracing System sound brace used on an arch top stringed musical instrument sound board according to at least one other embodiment discussed herein.

FIG. 5C is a perspective internal view of an arch top stringed musical instrument sound board, such as pertaining to a cello or double bass, with a Spring Bracing System therein according to at least one other embodiment of the Spring Bracing System discussed herein.

FIG. 6A is a perspective internal side view of an arch top stringed musical instrument sound board and rear sound plate with a Spring Bracing System and adjustable rear sound post therein according to at least one other embodiment of the Spring Bracing System discussed herein.

FIG. 6B is side view of one other Spring Bracing System sound brace used on an arch top stringed musical instrument sound board according to at least one other embodiment discussed herein.

FIG. 6C is sectional view of an arch top stringed musical instrument sound board, showing the Spring Bracing System components that are in contact with the sound board in relation to the string bridge of the instrument according to at least one other embodiment discussed herein.

FIG. 6D is a perspective side view of an adjustable rear sound post according to at least one other embodiment of the Spring Bracing System discussed herein.

FIG. 6E is a perspective internal view of an arch top stringed musical instrument sound board, such as pertaining to a cello or double bass, with a Spring Bracing System and adjustable rear sound post therein according to at least one other embodiment of the Spring Bracing System discussed herein.

DRAWING NUMERAL REFERENCE

Figure 3A:
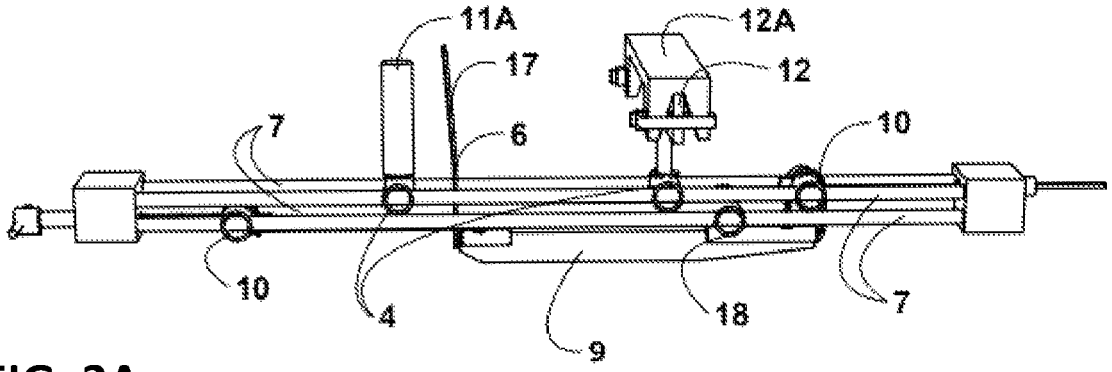
FIG. 3A is a side view of the Spring Bracing System according to at least one embodiment discussed herein.

4 Post brace mounts
5 Brace rail retaining blocks
5A Retaining block lower center hole
5B Retaining block upper center hole
6 Spring brace cord
7 Spring brace rails
8 Cord tensioner
8A Knob extender
9 Fulcrum lever
10 Cord tension mounts
11A Sound post
11B1 Sound brace post extension

11B2 Sound brace semi-circular extension
2B Classical guitar fan bracing
11C Adjustable or fitted rear sound post
11C1 Post upper section
11C2 Post threaded rod
11C3 Post lower threaded section
11C4 Post hole
11F Conventional sound post
12 Sound brace
12A Brace retainer
13 Tension mount position cord
14 Cord fastener
15 Cord entry hole
16 Cord return hole
17 Aglet
18 Fulcrum mount
19 Hinge type fastener
20 Post brace mounting rods
20A Post rod stop washers
22 Nylon cable ties
1A Steel string guitar sound board
1B Steel string guitar X-bracing
1C Steel string guitar steel strings
1D Steel string guitar round sound hole
1F Steel string guitar bridge pin holes
1E Steel string guitar string bridge
1G Steel string guitar bridge pins
2A Classical guitar sound board
2C Classical guitar sound hole
2E Classical guitar string bridge
2F Classical guitar string bridge cord access hole
3A Arch top sound board
3E Arch top F sound hole
3C Arch top string bridge
3B Arch top bass bar brace
3G rear sound plate
23A Cord tension diverter
23B Diverter position cord
24 Rod tension diverter
25 Semi-flexible spring rod
26 Pivot rod

DETAILED DESCRIPTION OF THE INVENTION

The spring brace system is mounted within the hollow body of the stringed musical instrument on the underside of its sound board top. Embodiments described in this disclosure are shown for the Spring Bracing System mounted on the sound board tops of three different types of traditional stringed musical instruments, as shown; FIG. 1B Steel String Guitar sound board 1A, FIG. 4C Classical Guitar sound board 2A, and FIG. 5C Arch Top sound board instruments (unlimiting examples include violin, viola, and cello) 3A. Each of these three types of stringed musical instruments has a string bridge which transfers vibration energy from the vibrating strings to the sound board top. Each of the three sound boards also have sound board reinforcement bracing that provides structural support to counter the tensional forces of the stringed musical instrument's strings and influences the tonal sound properties of the instrument. The musical sound from these instruments is made by the vibrating sound board moving air from the chamber of the instrument's hollow body, similar to how a sound speaker works. The string bridges, sound boards, and reinforcement bracing are all coupled with regard to the transfer of vibration energy from the instrument's vibrating strings. As shown and discussed in greater detail later in this disclosure, the sound brace system improves the transfer of string vibration to the sound board and improves the spring quality of the sound board top, also related to the sound board's vibration efficiency. Although relevant to all three embodiments disclosed, the spring bracing system's use of a rear sound post 11C to connect with the rear sound plate 3G, back of stringed musical instrument, is only shown for the Arch Top sound board 3A embodiment. Embodiments of the spring brace system frame are also shown where a rear sound post 11C is connected to a semi-flexible spring rod 25 mounted on the spring brace frame. It is expressly stated herein that the Spring Bracing System is intended to work with any traditional and known in the art stringed musical instrument. Unlimiting examples of such stringed musical instrument include guitar, violin, viola, and cello.

Referring to FIG. 1B, shows the preferred embodiment of the Spring Bracing System, mounted within an unmodified steel string guitar having an X-braced 1B sound board 1A, and a round sound hole 1D that also provides access to the spring brace cord tensioner 8. This embodiment is adaptable to many commercially produced steel string guitars, resulting in improved depth of sound and musical note sustain.

Referring again to FIG. 1B, shows the Spring Bracing System fastened entirely to the instrument by the two ends of the spring brace cord 6. FIG. 1A shows the guitar's string bridge 1E and bridge pins 1G, used to attach its steel strings 1C to the string bridge 1E. Referring to FIG. 2B, shows both ends of the spring brace cord 6 exiting the fulcrum lever 9 and entering the 4th and $5^{th}$ string bridge pin holes 1F. Referring again to FIG. 1A, shows both ends of the spring brace cord 6 exiting the string bridge pin holes 1F and secured to the string bridge 1E by the cord fastener 14, comprised of a common aluminum or brass fishing line crimp. The two bridge pins 1G used for the $4^{th}$ and $5^{th}$ string bridge pin holes 1F are smaller in diameter to the other bridge pins 1G or shaved on one side, allowing space for the ends of the spring brace cord 6 and the steel guitar strings 1C.

Referring to FIGS. 2A and 2B, shows the Spring Bracing System is comprised of a frame consisting of four spring rails 7 supported by two brace rail retaining blocks 5, a spring brace cord 6, two post brace mounts 4, cord tensioner 8, two cord tension mounts 10, a tension mount position cord 13, a fulcrum lever 9, sound post 11A, and sound brace 12. The Spring Bracing System improves the performance of the instrument's sound board by enhancing the transfer of vibration energy from the string bridge 1E to the sound post 11A and sound brace 12. The spring quality of the sound board 1A is improved by the fulcrum pivoting effect created by the sound post 11A and sound brace 12 working with the Spring Bracing System frame, allowing the sound board 1A to vibrate for longer durations with improved sound volume.

Referring again to the spring brace components shown in FIG. 1A, FIG. 1B and FIG. 2B, the Spring Brace System allows the musician to customize the tone of the instrument by simply adjusting the position of the sound post 11A and sound brace 12 on the sound board, changing the location where the spring brace cord 6 is attached to the string bridge 1E, or changing the type of sound post 11A or sound brace 12 used. Other embodiments, later discussed in this disclosure, show how the sound post 11A and sound brace 12 can be modified and changed. The cord tensioner 8, accessible from the instrument's sound hole 1D, allows the musician to make additional adjustments to the instrument's sound by changing the tension of the spring brace cord 6.

Figure 3B:
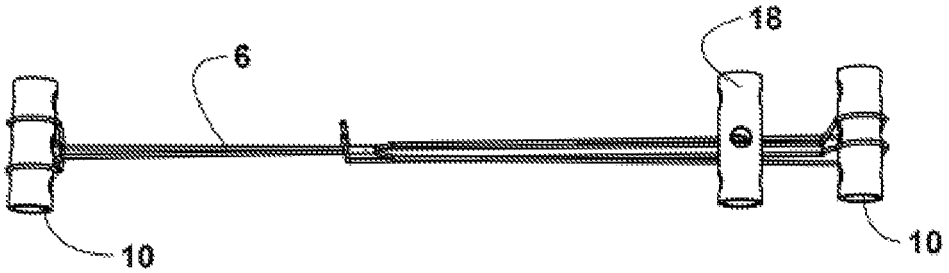
FIG. 3B is a top view of the Spring Bracing System spring brace cord, removed from the Spring Bracing System, according to at least one embodiment discussed herein.
Figure 3C:
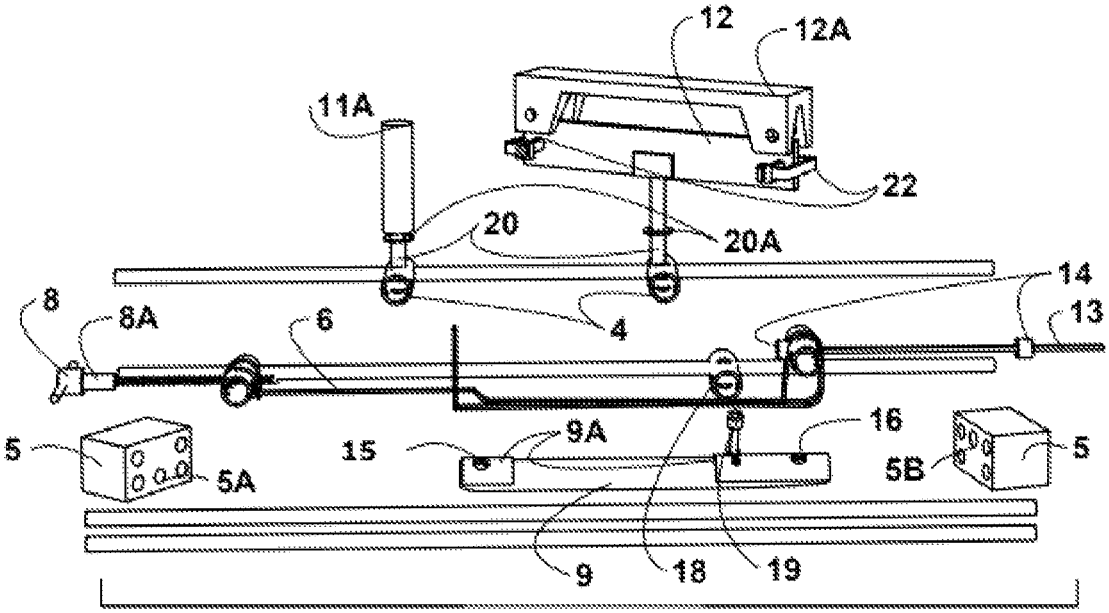
FIG. 3C is an exploded view of the Spring Bracing System according to at least one embodiment discussed herein.

FIG. 3A and FIG. 3C show details of the components used to construct this embodiment of Spring Bracing System, all comprised of lightweight materials capable of efficiently transferring string vibration energy throughout the Spring Bracing System. The spring brace rails 7 are made of 3 mm carbon fiber rod, commonly used to fabricate model aircraft and drones. Although this embodiment shows the Spring Bracing System having only four spring brace rails 7, a plurality of spring brace rails 7 comprised of different materials can be used. One or more additional spring brace rails 7 can be added to each side of this steel string guitar embodiment for greater rigidity. An embodiment of the spring brace frame is described later in this disclosure having only two spring brace rails made of wood. One other embodiment of the spring brace frame, described in this disclosure, utilizes a semi-flexible spring brace rod comprised of the same 3 mm carbon fiber rod material used for spring brace rail 7 but mounted between two opposite spring brace rails 7, retained by the brace rail retaining block 5 ends. The brace rail retaining blocks 5 are made of ½" by ¾" high density polyethylene (HDPE), each having partially drilled holes on the corners to retain the spring brace rail 7 sections in place. The front retaining block 5 is also drilled at the center 5A of its lower section to support the cord tensioner 8. The rear rail retaining block 5 is drilled at the center 5B of its upper section to attach the tension mount position cord 13, secured by two fasteners 14, located in front of the rear cord tension mount 10 and end of the rear rail retaining block 5.

Referring to FIG. 3A and FIG. 3B, shows the spring brace cord 6 arrangement and tensioning system used to tension and fasten the Spring Bracing System to the sound board 1A. The tensioning system is comprised of the spring brace cord 6, a cord tensioner 8, basically a knob connected to a 6-32 screw, knob extender 8A, a hollow rod used to extend the cord tensioner 8 knob, and a front cord tension mount 10. A threaded hole made at the center of the front cord tension mount 10 allows it to move along the cord tensioner 8 screw to adjust the tension of spring brace cord 6 when the knob is turned. Braided Kevlar cord, often used for large kite flying and spear guns, is used for the spring brace cord 6 in this embodiment. Other, greater or less inelastic, flexible materials can be substituted and are readily available. An aliphatic resin, epoxy adhesive, or other material is used to create an aglet 17 on each end of the braided cord. The aglets 17 facilitate threading the cord thru the Spring Bracing System and cord fasteners 14 during installation. The spring brace cord 6 is also coated with a lubricant or other coating to reduce friction and dampening of string vibration energy. Nylon fishing cord is used for the tension mount position cord 13 in this embodiment. Alternately, Kevlar or a more elastic material can be used.

Referring to FIG. 3A, FIG. 3B and FIG. 3C, shows the fulcrum lever 9 and the spring brace cord 6 arrangement used within the Spring Bracing System. The fulcrum lever 9 is connected to the fulcrum mount 18 and held in position by the hinge type fastener 19, comprised of a metal pin fitted loosely on the fulcrum lever 9, allowing it to function as a hinge. A flexible cord can be used in place of the metal pin for the hinge type fastener 19 to fasten the fulcrum lever 9 to the fulcrum mount 18. The spring brace cord 6 is looped and fastened around the front threaded cord tension mount 10 where it is also separated into two sections. Both sections enter the fulcrum lever cord entry hole 15, exit and loop around the rear cord tension mount 10, enter the fulcrum lever cord return hole 16, and finally exit the front end of the fulcrum lever 9 where they are fastened to the string bridge 1E. Alternately, the spring brace cord 6 can bypass the cord entry hole 15 and cord return hole 16, entering and exiting the ends of the fulcrum lever 9. The fulcrum lever 9 is constructed of 7 mm carbon fiber tube, commonly used to fabricate model aircraft and drones. Metal or carbon fiber reinforcements 9A are epoxied at each end for structural support. Referring again to FIG. 2A and FIG. 2B, shows the non-reinforced ends of the fulcrum lever 9 are angled at each side to facilitate installation of the spring brace cord 6 within the component.

Referring again to the fulcrum lever 9 shown in FIG. 3A and FIG. 3C, the fulcrum lever 9 enhances the fulcrum effect created by the sound post 11A and sound brace 12. Also, it extends the point on the spring brace frame where the brace cord 6 can be fastened to the Spring Bracing System, relative to the fulcrum pivot point of the Spring Bracing System. The fulcrum pivoting effect of the Spring Bracing System can be adjusted by changing the dimensions of the fulcrum lever 9 or the position of the hinge type fastener 19. Alternate embodiments of the Spring Bracing System that function without a fulcrum lever 9 or spring brace cord 6 fastened to the soundboard 1A are shown and discussed later in this disclosure.

Referring again to FIG. 3A, shows details of the sound post 11A and sound brace 12 system used to transfer vibration energy to varied points on the sound board 1A and reinforcement bracing 18. The two post brace mounts 4, located on the upper spring rails 7, have center holes that allow insertion of the post brace mounting rods 20 and stop washers 20A. Both post brace mounting rods 20 can rotate for adjustment when inserted into the post brace mounts 4. The holes drilled on each side of the post brace mounts 4 allow them to slide on the spring brace rails 7 to adjust the position of the sound post 11A and sound brace 12 when inserted in the mounts 10. With the exception of the threaded front cord tension mount 10, all of the other cylindrical mounts that glide on the spring brace rails 7 are constructed of a ¼" light gauge metal, carbon fiber tubing, or alternate materials that are capable of transferring vibration energy with minimal dampening. The threaded front cord tension mount 10 is constructed from a thicker gauge ½" tubing material capable of supporting the threaded cord tensioner 8 rod. The sound post 11A is constructed from a 5/16" hardwood dowel. A hole is drilled at one end to allow insertion and fastening of the 3 mm carbon fiber post brace connecting rod 20. The sound brace 12 is fabricated by epoxying a 3 mm carbon fiber rod center section to a 10 mm by 2 mm carbon fiber bar, materials commonly used to fabricate model aircraft and drones. Epoxy is used to secure the stop washer 20A on the post-brace connecting rod 20. A loose-fitting wooden brace retainer 12A is used on the sound brace 12 to maintain its perpendicular angle to the sound board 1A and extend the surface area of the sound brace 12 in contact with the sound board. Loose fitting nylon cable ties 22 are used on each side of the brace retainer 12A to keep it in place during adjustments. The brace retainer 12A is made from Sitka spruce or some other light material capable of transferring vibration from the sound brace 12. The distance from the bottom of the sound brace 12 to the bottom center of the brace retainer 12A is kept at a minimum to maximize the transfer of vibration energy to the sound board 1A.

Installing the Spring Bracing System within the steel string guitar illustrated in FIG. 16 is a simple process. The fully assembled Spring Bracing System is placed in the instrument's cavity, the spring brace cord 6 ends are threaded into the bridge pin holes 1F and fastener 14. With the sound post 11A and sound brace 12 at their desired locations, both ends of the spring brace cord 6 are manually pulled and tightened and either tied or crimped to the fastener 14 and secured in place. The cord tensioner 8 is then turned several times to tension the spring brace cord 6. As previously discussed, a number of simple adjustments can be made to the installed Spring Bracing System to alter the sound of the instrument to the musician's preference.

Figure 4A:
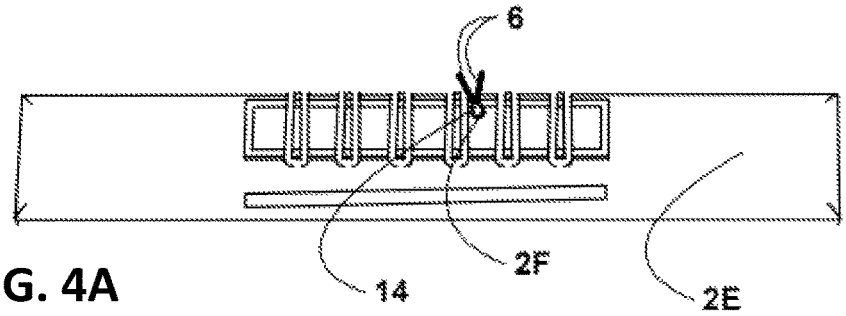
FIG. 4A is an external perspective view of the string bridge used on a nylon string classical guitar according to at least one other embodiment discussed herein.
Figure 4B:
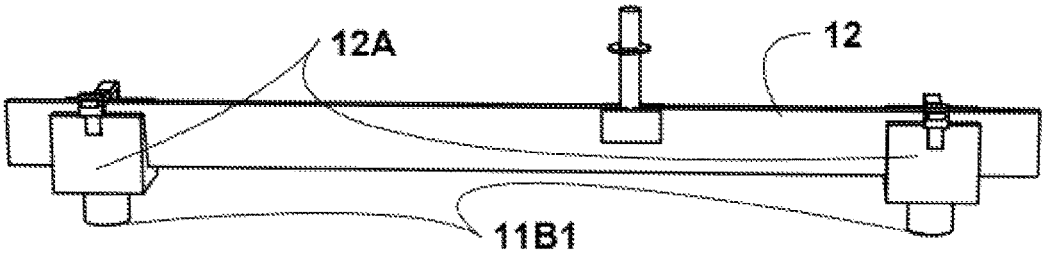
FIG. 4B is side view of the front Spring Bracing System sound brace used on a nylon string classical guitar according to at least one other embodiment discussed herein.
Figure 4C:
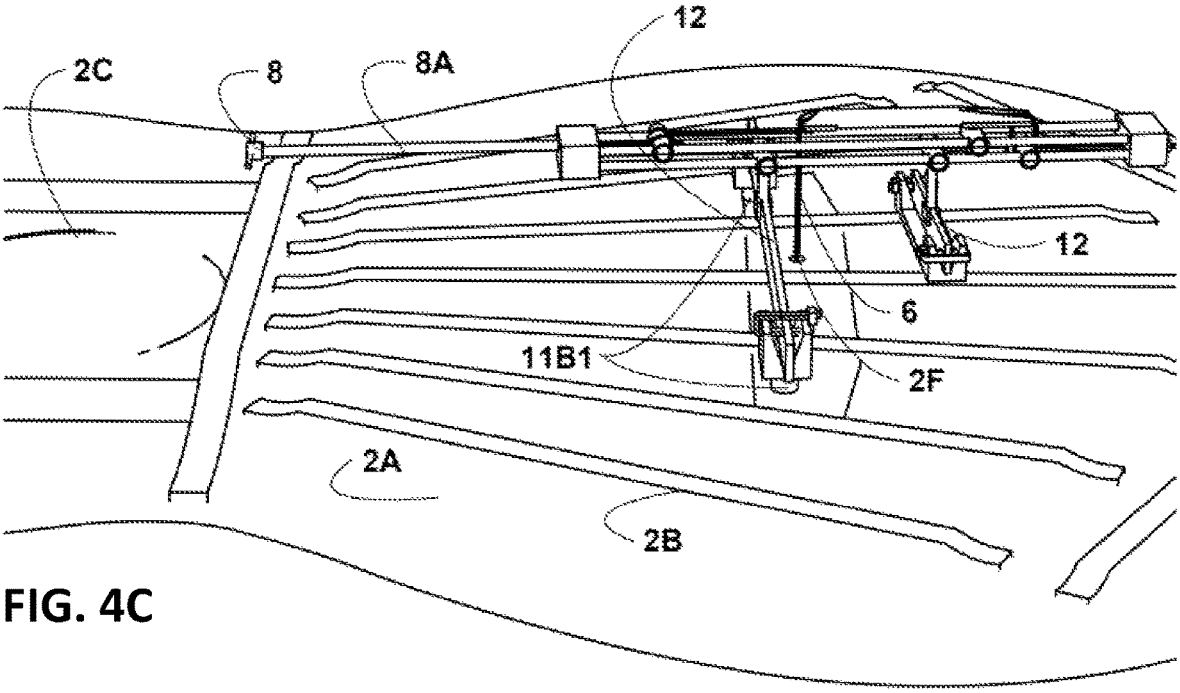
FIG. 4C is a perspective internal side view of a nylon string classical guitar sound board with a Spring Bracing System therein according to at least one other embodiment discussed herein.

Referring to FIG. 4C, illustrates an alternate embodiment of the Spring Bracing System, installed within a conventional nylon stringed classical guitar, having a fan braced 2B sound board 2A. The cord tensioner 8 and extension housing 8A are extended to allow access from the instrument sound hole 2C. Similar to the steel string guitar shown in FIG. 1B, the Spring Bracing System is fastened to the sound board at the string bridge 2E by the spring brace cord 6. Referring to FIG. 4A, shows both ends of the spring brace cord 6 exiting the string bridge 2E thru an access hole 2F created between the $4^{th}$ and $5^{th}$ nylon strings and secured in place with a fastener 14.

Referring again to FIG. 4C, shows a modified sound brace 12 used in place of the front sound post 11A used for the steel string guitar embodiment. Referring to FIG. 4B, the modified sound brace 9 utilizes two brace retainers 12A located at each end with sound brace post extensions 11B1 attached. The rear sound brace 9 is the same as used by the steel string guitar except it is positioned on top of the sound board 2A fan bracing 2B. Alternately, the sound brace 12 could be positioned diagonally, allowing it to rest on the sound board 2A between the two fan braces 2B.

Referring again to FIG. 4A and FIG. 4C, after the access hole 2F is created for the spring brace cord to pass thru the string bridge 2E, the process of installing an assembled Spring Bracing System within a classical nylon string guitar is similar to what was described for the steel string guitar shown in FIG. 1B. Along with improving the sound of a nylon stringed classical guitar, the Spring Bracing System can be used to stiffen the classical guitar sound board to allow use of higher tension strings and possibly some light gauge steel strings, preferred by some players.

FIG. 5C shows an alternate embodiment of the Spring Bracing System, installed within an arch top instrument such as a cello or double bass, having a conventional sound post 11F. Arch top instruments often utilize a conventional sound post 11F, basically a wooden dowel positioned at the rear of the treble side of the string bridge 11F, connected by friction to the top and back plates of the instrument. The conventional sound post 11F provides structural support to the arch top sound board 3A and helps transfer string vibration energy to the rear sound plate. It also serves a key role in crafting the musical tone made by the instrument. It is historically called the soul of the instrument in that its position relative to the bridge can alter the voice of the instrument. The Spring Bracing System can be used to improve the functionality of a conventional sound post 11F.

Referring again to FIG. 5C, shows the Spring Bracing System utilizes two modified sound braces 12 and a cord tensioner 8 accessible from the instrument's F sound hole 3E. FIG. 5B shows a side view of the modified sound brace 12 used for this embodiment. FIG. 5A shows a sectional view of the sound board, illustrating the Spring Bracing System components that are in contact with the sound board 3A in relation to the instrument's string bridge 3C. Referring to FIG. 5A, FIG. 5B, and FIG. 5C, show two semi-circular components 11B2 attached laterally to one end of each brace retainer 12A that are used to make contact with the bass bar 3B at opposite sides of the string bridge 3C. Two sound brace post extensions 11B1 attached to one end of each other brace retainer 12A, make contact to a point located in front of the conventional sound post 11F and point located adjacent to the instrument's side wall. The spring brace cord 6 is mounted thru a hole created in the instrument's bass bar 3B brace and sound board 3A, secured on the sound board 3A in front of the bass side of the string bridge 3C with a fastener 14. Alternately, the Spring Bracing System can be repositioned, having the spring brace cord 6 fastened directly to the string bridge 3C utilizing a hole created on the sound board 3A.

Referring again to the arch top sound board 3A shown in FIG. 5C, the performance of the sound board is improved by the sound braces 12 working together with the Spring Bracing System to enhance the fulcrum pivoting effect the conventional sound post 11F normally has with the bass side of the sound board 3A, enhancing the loudness and sustain of musical notes of the instrument. The added upward structural support provided to the front of the treble side of the bridge allows the conventional sound post 11F to be positioned further behind the foot of the treble side of the string bridge 3C, not common with a conventional arch top instrument design. It also reduces the frequency needed to replace the sound post due to normal deformation of the sound board 3A section in front of the sound post 11F and string bridge 3C.

Referring to FIG. 6A and FIG. 6E, show an alternate embodiment of the Spring Bracing System installed within the same arch top instrument embodiment illustrated in FIG. 5C. In this embodiment the conventional sound post 11F was removed and its function on the sound board 3A replaced with a sound brace post extension 11B1 attached to one end of a sound brace 12 positioned at the same location. FIG. 6B shows a side view of the modified sound brace 12.

Referring again to FIG. 6A and FIG. 6E, shows a fitted or adjustable rear sound post 11C, coupled to the Spring Bracing System and rear sound plate 3G. This rear sound post 11C is used to enhance the fulcrum pivoting effect of the Spring Bracing System on the sound board 3A, improve vibration transfer to the rear sound plate 3G, and provide additional upward structural support to the sound board 3A. FIG. 6D shows a side view of the fitted or rear adjustable sound post 11C. As shown in other embodiments of the Spring Bracing System brace frame, discussed later in this disclosure, the rear sound post 11C can be used independently mount the Spring Bracing System onto the musical instrument's sound board. FIG. 6C shows a sectional view of the sound board 3A, illustrating the Spring Bracing System components that are in contact with the sound board in relation to the instrument's string bridge 3C.

Referring again to FIG. 6E, shows the fitted or adjustable rear sound post 11C connected to the spring brace cord 6 on the Spring Bracing System. FIG. 6D shows the individual components of the adjustable rear sound post 11C, comprised of an upper section 11C1, a threaded rod 11C2, and lower threaded section 11C3, allowing the rear sound post 11C height to be adjusted by rotating the lower section 11C3. The upper section 11C1 has a sound post hole 11C4, enabling it to be fastened to the spring brace cord 6 or by some other means to the spring brace frame. Alternately, a one piece fitted rear sound post 11C could be used, held in place by compression. Variations to this embodiment can include mounting the rear sound post 11C at different positions on the Spring Bracing System or use of multiple rear sound posts 11C.

The Spring Bracing System can be installed within an existing arch top instrument by removing the sound board, sizing the Spring Bracing System to allow insertion into the F-sound hole 3E, or assembling the individual spring brace components within the instrument. After installation, the sound braces 12 can be repositioned and the total upward force transmitted by the Spring Bracing System onto the sound board 3A adjusted to alter and customize the sound of the instrument.

Figure 7A:
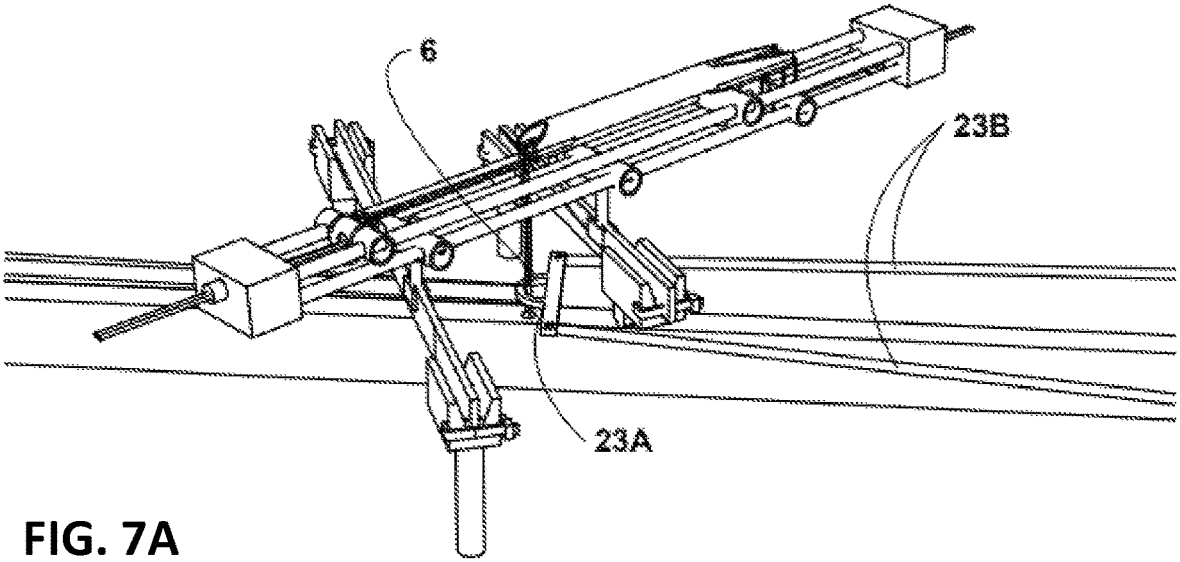
FIG. 7A is a perspective close up view of the Spring Bracing System, cord tension diverter component and spring brace cord arrangement, used by the cord tensioning system according to at least one other embodiment of the Spring Bracing System discussed herein.
Figure 7B:
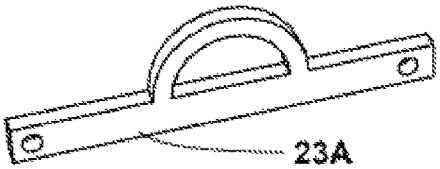
FIG. 7B is a perspective view of the cord tension diverter component used by the cord tensioning system according to at least one other embodiment of the Spring Bracing System discussed herein.
Figure 7C:
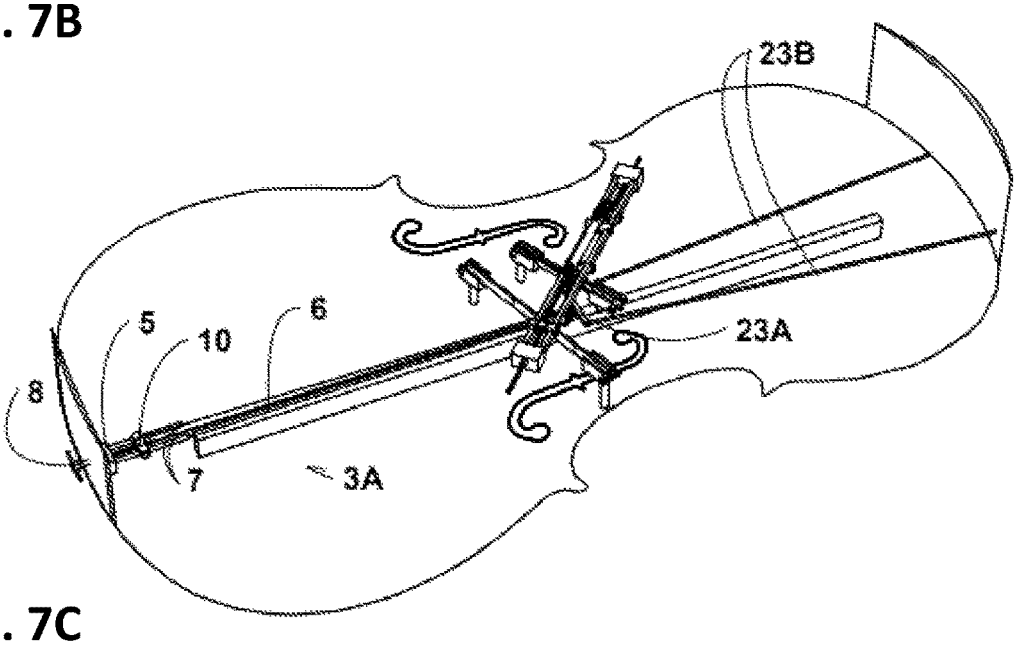
FIG. 7C is a perspective internal view of an arch top stringed musical instrument sound board with a Spring Bracing System and cord tensioning system therein according to at least one other embodiment discussed herein.

Referring to FIG. 7C, shows an alternate embodiment of the Spring Bracing System installed on an arch top instrument sound board 3A, where the cord tensioner 8 was removed from the Spring Bracing System and replaced with a tension mount position cord 13 fastened to a cord tension mount 10 and connected to a brace rail retaining block 5. The spring brace cord 6 is tensioned by a cord tensioner 8 mounted on a body wall of the instrument.

Referring to FIG. 7B, shows a close-up view of the cord tension diverter 23. The cord tension diverter 23A is used to divert the vertically tensioned exiting spring brace cord 6 from the Spring Bracing System to the cord tensioner 8. The fasteners 14 used to fasten the diverter position cords 23B on the top wall of the instrument are not shown. Referring to FIG. 7A and again to FIG. 7C, the spring brace cord 6 exits the end of the fulcrum lever 9 and is diverted by looping under the round D-ring section of the cord tension diverter 23A to the threaded cord tension mount on the cord tensioner 8. The ends of the spring brace cord 6 return back to the cord tension diverter 23A where they are looped again over the round D-ring section of the diverter 23A to the hole in the bass bar 3B brace, and ultimately fastened to a point on the sound board 3A as described in the prior disclosed arch top instrument embodiment.

The cord tensioner 8 can be positioned at other locations on the instrument's body as long as the Spring Bracing System can maintain an equilibrium position relative to the sound board 3A when the cord tensioner 8 is tightened. The cord tensioner 8 can also consist of a mechanism separate from the stringed musical instrument, allowing the spring brace cord 6 to be tensioned and fastened similar to how cords on tennis rackets are tightened. Alternately, the spring brace cord 6 can be tensioned manually.

Figure 8A:
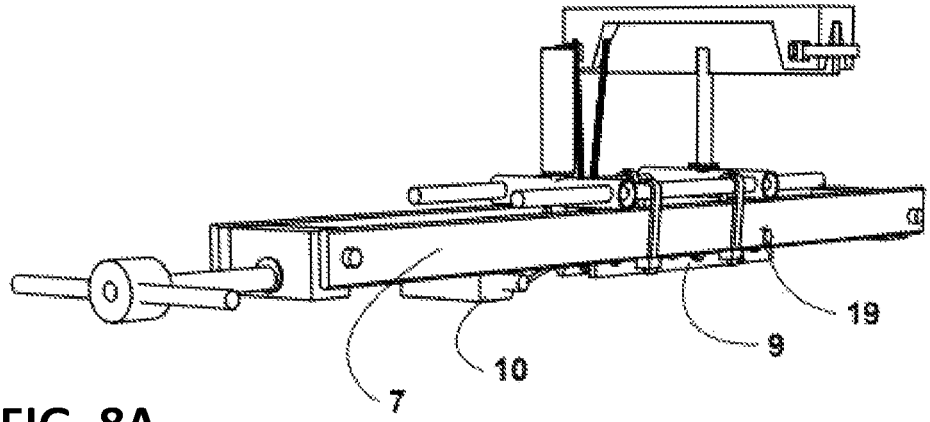
FIG. 8A is a side perspective view of the Spring Bracing System, according to at least one other embodiment discussed herein.
Figure 8B:
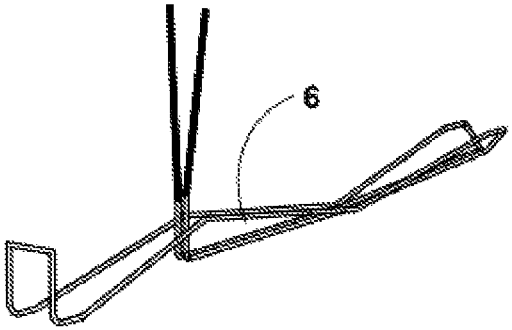
FIG. 8B is a side perspective close up view of the Spring Bracing System spring brace cord removed from the Spring Bracing System according to at least one other embodiment discussed herein.
Figure 8C:
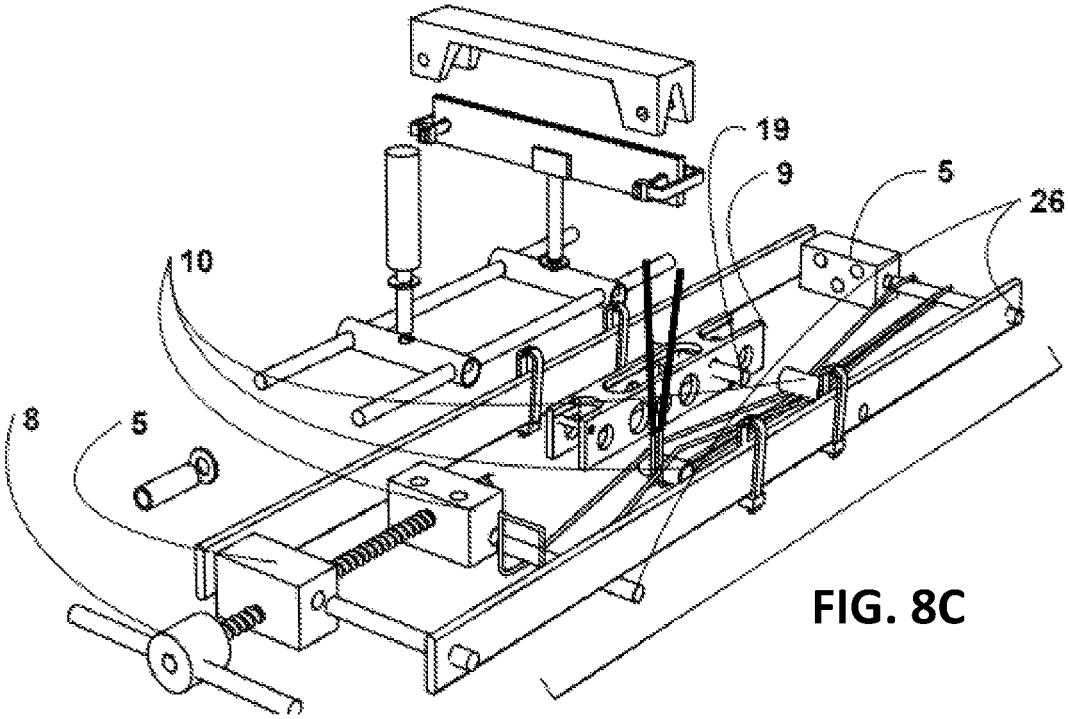
FIG. 8C is an exploded view of the Spring Bracing System according to at least one other embodiment discussed herein.

Referring to FIG. 8A, FIG. 8B and FIG. 8C, show an alternate embodiment of the Spring Bracing System having spring brace rails 7, a fulcrum lever 9, hinge type fastener 19, cord tension mounts 10, brace rail retaining blocks 5, and spring brace cord 9, configured differently than prior disclosed Spring Bracing System embodiments but having the same functionality.

Referring again to FIG. 8C, shows rectangular brace sections used for the lower spring brace rails 7 made of musical instrument tone woods such as rosewood, maple, or ebony. The fulcrum lever 9 is machined from aluminum. Light gauge metal cylinders fastened within the fulcrum lever 9 function as cord tension mounts 10 and are used to convey tension from the spring brace cord 6 thru the Spring Bracing System. The fulcrum lever 9 is mounted to the lower spring brace rails 7 by a hinge type fastener 19, which acts as a hinge, held in place by the sides of the spring brace rails 7.

Referring again to FIG. 8B and FIG. 8C, shows the spring brace cord 6 loops around a pivot rod 26 which fastens the rear retaining block 5 to the lower spring rails. The threaded front tension mount 10 is comprised of a block utilizing a lower pivot rod 26 to prevent it from rising when the Spring Bracing System is tensioned by the cord tensioner 8.

Referring again to FIG. 8C, shows the sound post 11A and sound brace 12 mounted on a separate spring brace rail 7 system not fastened to the brace rail retaining blocks 5, attached to the lower spring brace rail 7 section with nylon ties 22.

Figure 9A:
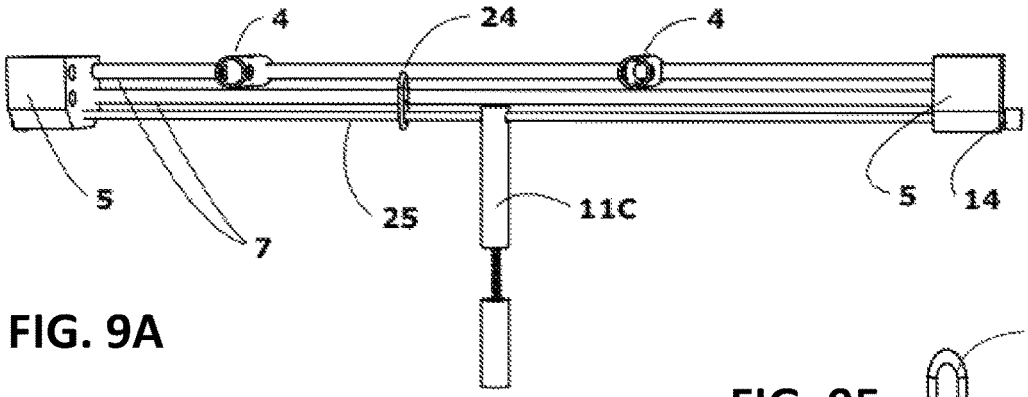
FIG. 9A is a side perspective view of the Spring Bracing System, excluding two spring brace rails and upper section, according to at least one other embodiment discussed herein.
Figure 9E:
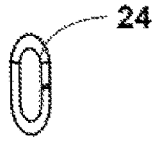
FIG. 9E is a side perspective view of the rod tension diverter according to at least one other embodiment of the Spring Bracing System discussed herein.
Figure 9B:
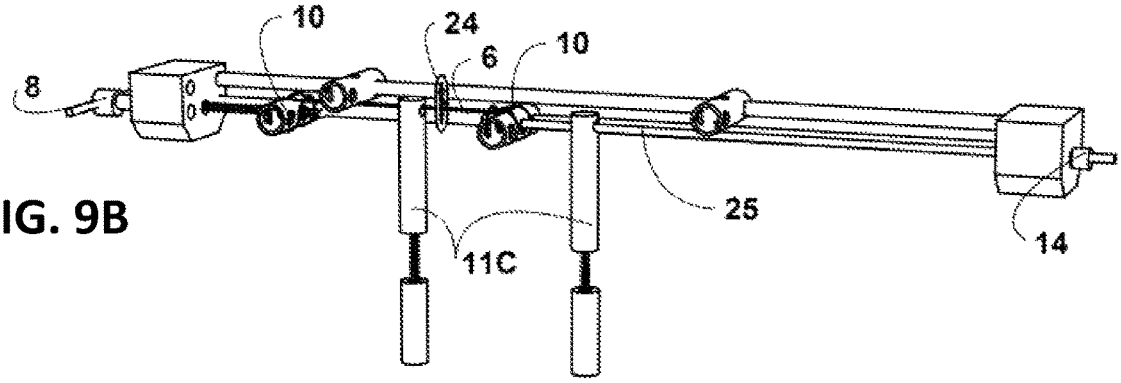
FIG. 9B is a side perspective view of the Spring Bracing System, excluding two spring brace rails and upper section, according to at least one other embodiment discussed herein.

Referring to FIG. 9A and FIG. 9B, show variations of the Spring Bracing System frame that do not utilize a fulcrum lever 9 or require a spring brace cord 6 to mount the Spring Bracing System onto the sound board. A semi-flexible spring rod 25, fastened to both brace rail retaining blocks 5, is used to improve the fulcrum pivoting effect created by the sound post 11A and sound brace 12 working with the Spring Bracing System frame. The semi-flexible spring rod 25 is made of 3 mm carbon fiber rod. Alternately, it can also be made of steel, wood, or steel cable. A tensioned spring brace cord 6 can also be used in place of the semi-flexible spring rod 25 and have the same functionality. The two facing side spring brace rails 7 are not shown to allow views of the inner details.

Referring again to FIG. 9A and FIG. 9B, show both Spring Bracing System frame variations having a rod tension diverter 24, also shown in FIG. 9E, mounted on their semi-flexible spring rod 25. The rod tension diverter 24 provides a means of improving the transfer of string vibration energy to the Spring Bracing System frame by connecting the semi-flexible spring rod 25 to the musical instrument sound board by use of a fastened spring brace cord 6.

Referring to FIG. 9A, shows a Spring Bracing System frame having a lower semi-flexible spring rod 25 fastened to both brace rail retaining blocks 5, coupled to an adjustable rear sound posts 11C at its sound post hole 11C4. The upward force needed to fasten the Spring Bracing System onto the sound board is created by the tensioned adjustable rear sound post 11C, braced by the rear sound plate 3G, and creating a compressive force between the spring brace frame and rear sound plate 3G.

Referring to FIG. 9B, shows the Spring Bracing System frame shown in FIG. 9A, where one end of the lower semi-flexible spring rod 25 is fastened to the center of one cord tension mount 10 and one other cord tension mount 10 connected to a cord tensioner 8, and where both cord tension mounts 10 are fastened to the spring brace cord 6 and the cord tensioner is used to tension the lower semi-flexible spring rod 25 within the Spring Bracing System frame. Alternately, the cord tension mount 10 and connected cord tensioner 8 could be replaced with a tension mount position cord 13 fastened to a brace rail retaining block 5. Referring again to FIG. 9B, one rear adjustable sound posts 11C is connected to the lower semi-flexible spring rod 25 at its sound post hole 11C4, and another rear adjustable sound posts 11C is connected to the spring brace cord 6 at its sound post hole 11C4. Both rear adjustable sound posts 11C are used to provide the compressive force needed to fasten the Spring Bracing System onto the sound board.

Figure 9C:
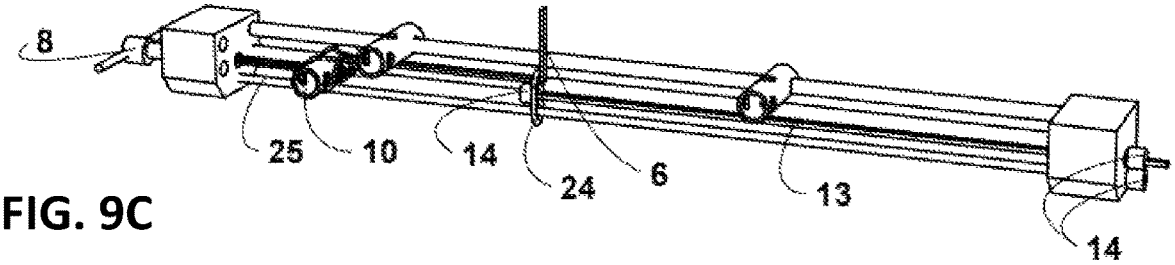
FIG. 9C is a side perspective view of the Spring Bracing System, excluding two side spring rails and upper section, according to at least one other embodiment discussed herein.
Figure 9D:
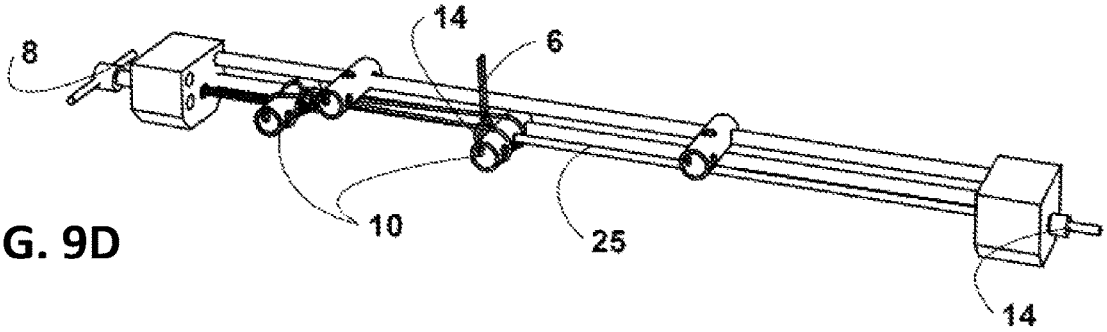
FIG. 9D is a side perspective view of the Spring Bracing System, excluding two spring brace rails and upper section, according to at least one other embodiment discussed herein.

Referring to FIG. 9C and FIG. 9D, show two additional variations of the Spring Bracing System frames. Both Spring Bracing System frame variations utilize a semi-flexible spring rod 25, a cord tension mount 10 connected to a cord tensioner 8, and a spring brace cord 6 diverted to the sound board for fastening by either one other cord tension mount 10 or a rod tension diverter 24 connected to the semi-flexible spring rod 25. The two facing side spring brace rails 7 are not shown to allow views of the inner details.

Referring to FIG. 9C, shows a cord tensioner added to the lower spring brace rails 7 of the Spring Bracing System frame shown in FIG. 9A and used to tighten a spring brace cord 6, diverted toward the sound board by the rod tension diverter 24, connected to the semi-flexible spring rod 25, held in position by the position retaining cord 13 fastened to the rear rail retaining block 5.

Referring to FIG. 9D, shows the Spring Bracing System frame shown in FIG. 9B, where the spring brace cord 6 ends loop around the tension mount 10, mounted on the lower spring brace rails 7, fastened to a semi-flexible spring rod 25, and diverted toward the soundboard.

Figure 10A:
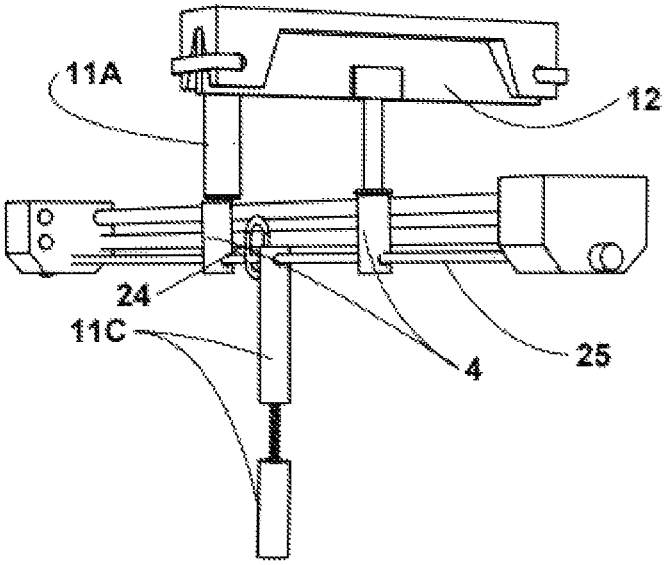
FIG. 10A is a perspective view of a variation of the spring brace frame illustrated in FIG. 9A according to at least one other embodiment of the Spring Bracing System discussed herein.

Referring to FIG. 10A, shows an embodiment of the Spring Bracing System utilizing the spring brace frame illustrated in FIG. 9A with a modified post brace mount 4 system. Referring again to FIG. 10A, show the two post brace mounts 4 are mounted vertically, having a means of gliding on the semi-flexible rod 25 utilizing holes drilled on their lower ends. A vertical hole drilled at the center of each post brace mount 4 is used to retain each post brace mounting rod 20, sound post 11A, and sound brace 12 in their vertical position.

Referring again to FIG. 10A, shows an adjustable rear sound post 11C and rod tension diverter 24, fastened to the semi-flexible rod 25. The Spring Bracing System is mounted onto the sound board by the upward force created by the tensioned adjustable rear sound post 11C. A spring brace cord 6, connected to the sound board and the rod tension diverter 24, can be used to mount the Spring Bracing System onto the sound board in place of the rear sound post 11C.

Figure 10B:
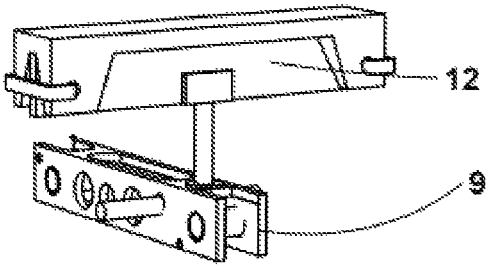
FIG. 10B is a side perspective view of the fulcrum and sound brace component illustrated in FIG. 10C to at least one other embodiment of the Spring Bracing System discussed herein.
Figure 10C:
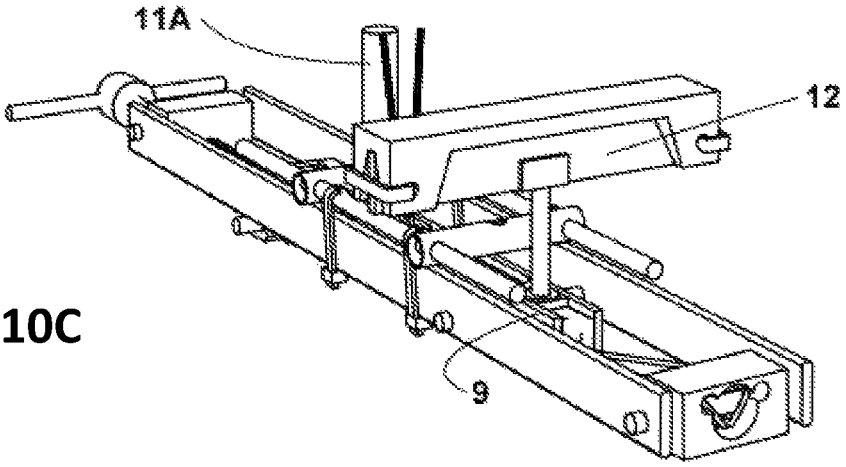
FIG. 10C is a perspective view of a variation of the spring brace illustrated in FIG. 8C according to at least one other embodiment of the Spring Bracing System discussed herein.

Referring to FIG. 10B, shows an embodiment of the Spring Bracing System illustrated in FIG. 8C where one end of the fulcrum lever 9 is used to mount a sound brace 12. FIG. 10C illustrates details of the mounted sound brace 12 and fulcrum lever 9. Referring again to FIG. 10C, shows a hole made on one side of the fulcrum lever 9 allowing it to function as a post brace mount 4. The hole is used to vertically fasten either a sound post 11A or sound brace 12 mounted on a post brace mounting rod 20.

It is important to note that the construction and arrangement of the Spring Bracing System as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims

The invention claimed is:

1. A spring bracing system for a stringed musical instrument known and traditional in the art and readily available on the market, wherein the stringed musical instrument comprises strings, a neck, a string bridge, and a hollow body; wherein the hollow body comprises a sound board top, a rear sound plate, and a sound board reinforcement bracing; wherein the sound board top comprises at least one sound hole; and wherein string vibration energy is generated when the strings are played and the string vibration energy is transmitted on the stringed musical instrument from the strings to the string bridge, the sound board top, and the reinforcement bracing;

the spring bracing system comprising:

a spring brace frame, the spring brace frame comprises a plurality of spring brace rails, the plurality of spring brace rails laterally separated and fastened at each end to one of two brace rail retaining blocks; at least two post brace mounts, wherein the at least two post brace mounts are positioned on at least two upper spring brace rails of the plurality of spring brace rails;

at least two post brace mounting rods, wherein each post brace mounting rod is attached to a respective post brace mount of the at least two post brace mounts;

a sound post, wherein the sound post is attached to a post brace mounting rod of the at least two post brace mounting rods;

at least one sound brace, wherein the at least one sound brace is attached to a post brace mounting rod of the at least two post brace mounting rods; and, wherein the at least one sound brace is interchangeable with the sound post attached to another post brace mounting rod of the at least two post brace mounting rods; and, a spring brace tensioning system, the spring brace tensioning system comprises a spring brace cord; at least two cord tension mounts, wherein the at least two cord tension mounts are positioned on at least two upper or lower spring brace rails of the plurality of spring brace rails; wherein at least one of the at least two cord tension mounts is fastened to at least one of the two brace rail retaining blocks by at least one tension mount position cord; and, wherein the spring brace cord is looped around each cord tension mount of the at least two cord tension mounts; and, a fulcrum lever system, the fulcrum lever system comprises a fulcrum lever, and a hinge type fastener; wherein the hinge type fastener is used to fasten the fulcrum lever on a fulcrum mount positioned on at least two spring brace rails on opposite sides of the spring brace frame or used to fasten the fulcrum lever onto each opposite side of the at least two spring brace rails, and flanked by the spring brace cord.

2. The spring bracing system of claim 1, further comprising a fastener, wherein when the spring bracing system is installed within the hollow body of the stringed musical instrument, ends of the spring brace cord are threaded into at least one hole in the stringed musical instrument sound board top or string bridge mounted on the sound board top, and fastened there with the fastener.

3. The spring bracing system of claim 1, further comprising a cord tensioner attached to a length of the spring brace cord; mounted on the spring brace frame, on the hollow body of the stringed musical instrument, or not permanently mounted on the stringed musical instrument and used as a separate device; wherein when the spring bracing system is installed within the hollow body of the stringed musical instrument, the cord tensioner providing a manual means of adjusting the length of the spring brace cord within the spring bracing system; wherein at least one end of the spring brace cord is fastened to the cord tensioner; and, wherein at least one other end of the spring brace cord is fastened to the sound board top or string bridge; and, wherein the length of the spring brace cord is maintained in tension within the spring brace frame, thus controlling the tension of the spring brace cord as the length of the spring brace cord is changed between the cord tensioner and the sound board top or string bridge.

4. The spring bracing system of claim 1, further comprising at least one brace retainer positioned on top of the at least one sound brace, wherein when the spring bracing system is installed within the hollow body of the stringed musical instrument and positioned on the sound board top, the at least one brace retainer providing a sound brace modification means of extending and changing all or parts of the surface area on top of the at least one sound brace in contact with the sound board top or the sound board reinforcement bracing, affected by the spring bracing system.

5. The spring bracing system of claim 1, wherein when the spring bracing system is installed within the hollow body of the stringed musical instrument the sound post and at the least one sound brace are positioned on the sound board top.

6. A spring bracing system for a stringed musical instrument known and traditional in the art and readily available on the market, wherein the stringed musical instrument comprises strings, a neck, a string bridge, and a hollow body; wherein the hollow body comprises a sound board top, a rear sound plate, and a sound board reinforcement bracing; wherein the sound board top comprises at least one sound hole; and wherein string vibration energy is generated when the strings are played and the string vibration energy is transmitted on the stringed musical instrument from the strings to the string bridge, the sound board top, and the reinforcement bracing;

the spring bracing system comprising:

a spring brace frame, the spring brace frame comprises a plurality of spring brace rails, the plurality of spring brace rails laterally separated and fastened at each end to one of two brace rail retaining blocks, at least one semi-flexible spring rod having two ends; wherein one end of the semi-flexible rod is fastened to at least one of the two brace rail retaining blocks; at least two post brace mounts, wherein the at least two post brace mounts are positioned on at least two upper spring brace rails of the plurality of spring brace rails or positioned on the at least one semi-flexible spring rod;

at least two post brace mounting rods, wherein each post brace mounting rod is attached to a respective post brace mount of the at least two post brace mounts;

a sound post, wherein the sound post is attached to a post brace mounting rod of the at least two post brace mounting rods;

at least one sound brace, wherein the at least one sound brace is attached to a post brace mounting rod of the at least two post brace mounting rods; and, wherein the at least one sound brace is interchangeable with the sound post attached to another post brace mounting rod of the at least two post brace mounting rods; and, a spring brace tensioning system, the spring brace tensioning system comprises a spring brace cord and, at least one cord tension mount, wherein the at least one cord tension mount is positioned on at least two of the spring brace rails of the plurality of spring brace rails on opposite sides of the spring brace frame; wherein the at least one cord tension mount is positioned on the at least one semi-flexible rod or connected to the at least one semi-flexible rod with the spring brace cord, wherein the spring brace cord loops around the at least one cord tension mount or a cord tension diverter connected to the at least one semi-flexible rod.

7. The spring bracing system of claim 6, further comprising a fastener, wherein when the spring bracing system is installed within the hollow body of the stringed musical instrument, ends of the spring brace cord are threaded into at least one hole in a stringed musical instrument's sound board top or string bridge mounted on the sound board top, and fastened there with the fastener.

8. The spring bracing system of claim 6, further comprising at least one brace retainer positioned on top of the at least one sound brace, wherein when the spring bracing system is installed within the hollow body of the stringed musical instrument and positioned on the sound board top, the at least one brace retainer providing a sound brace modification means of extending and changing at least one surface area on the top of the at least one sound brace in contact with the sound board top, sound board reinforcement bracing, affected by the spring bracing system.

9. The spring bracing system of claim 6, further comprising a cord tensioner attached to a length of the spring brace cord; mounted on the spring brace frame, on the hollow body of the stringed musical instrument, or not permanently mounted on the stringed musical instrument and used as a separate device; wherein when the spring bracing system is installed within the hollow body of the stringed musical instrument, the cord tensioner providing a manual means of adjusting the length of the spring brace cord within the spring bracing system; wherein at least one end of the spring brace cord is fastened to the cord tensioner; and, wherein at least one other end of the spring brace cord is fastened to the sound board top or string bridge; and, wherein the length of the spring brace cord is maintained in tension within the spring brace frame, thus controlling the tension of the spring brace cord as the length of the spring brace cord is changed between the cord tensioner and the sound board top or string bridge.

10. The spring bracing system of claim 6, wherein when the spring bracing system is installed within the hollow body of the stringed musical instrument the sound post and the at least one sound brace are positioned on the sound board top.

11. A spring bracing system for a stringed musical instrument known and traditional in the art and readily available on the market, wherein the stringed musical instrument comprises strings, a neck, a string bridge, and a hollow body; wherein the hollow body comprises a sound board top, a rear sound plate, and a sound board reinforcement bracing; wherein the sound board top comprises at least one sound hole; and wherein string vibration energy is generated when the strings are played and the string vibration energy is transmitted on the stringed musical instrument from the strings to the string bridge, the sound board top, and the reinforcement bracing;

the spring bracing system comprising:

a spring brace frame, the spring brace frame comprises a plurality of spring brace rails, the plurality of spring brace rails laterally separated and fastened at each end to one of two brace rail retaining blocks; at least one semi-flexible spring rod, having two ends, fastened at one end to one of the two brace rail retaining blocks; the at least one semi-flexible spring rod fastened at one other end to the other brace rail retaining block of the two brace rail retaining blocks or to at least one cord tension mount connected to the other brace rail retaining block of the two brace rail retaining blocks by a spring brace cord or a tension mount position cord; at least two post brace mounts, wherein the at least two post brace mounts are positioned on at least two upper spring brace rails of the plurality of spring brace rails or positioned on the at least one semi-flexible spring rod; at least one rear sound post wherein the at least one rear sound post is connected at one end to the at least one semi-flexible spring rod or to the spring brace cord connected to the at least one semi-flexible spring rod;

at least two post brace mounting rods, wherein each post brace mounting rod is attached to a respective post brace mount of the at least two post brace mounts;

a sound post, wherein the sound post is attached to a post brace mounting rod of the at least two post brace mounting rods; and, at least one sound brace, wherein the at least one sound brace is attached to a post brace mounting rod of the at least two post brace mounting rods; and, wherein the at least one sound brace is interchangeable with the sound post attached to another post brace mounting rod of the at least two post brace mounting rods.

12. The spring bracing system of claim 11, further comprising a spring rod tensioning system, the spring rod tensioning system comprising the at least one rear sound post in tension at both ends when installed within the hollow body of the musical string instrument; wherein the height of the at least one rear sound post is sufficient to allow one other end of the at least one rear sound post to contact the rear sound plate when installed within the hollow body of the stringed musical instrument; a manual means of adjusting the height of the at least one rear sound post connected to the at least one semi-flexible spring rod or to the spring brace cord connected to the at least one semi-flexible spring rod, mounted on the spring brace frame; wherein the at least one rear sound post installed within the hollow body of the musical string instrument and positioned on the rear sound plate and on the at least one semi-flexible spring rod or on the spring brace cord connected to the at least one semi-flexible spring rod, mounted on the spring brace frame; and, thus controlling the tension of the semi-flexible spring rod and upward force directed by the Spring Bracing System installed within the hollow body of the musical string instrument onto the sound board top when the height of the at least one rear sound post is changed.

13. The spring bracing system of claim 11, further comprising at least one brace retainer positioned on top of the at least one sound brace, wherein when the spring bracing system is installed within the hollow body of the stringed musical instrument and positioned on the sound board top, the at least one brace retainer providing a sound brace modification means of extending and changing at least one surface area on the top of the at least one sound brace in contact with the sound board top, sound board reinforcement bracing, and affected by the spring bracing system.

14. The spring bracing system of claim 11, wherein when the spring bracing system is installed within the hollow body of the stringed musical instrument the sound post and the at least one sound brace are positioned on the sound board top.

* * * * *